US012704052B1

(12) United States Patent
Reid

(10) Patent No.: US 12,704,052 B1
(45) Date of Patent: Aug. 11, 2026

(54) GAS LIFT MANDREL

(71) Applicant: Matthew Jordan Anthony Reid, Sexsmith (CA)

(72) Inventor: Matthew Jordan Anthony Reid, Sexsmith (CA)

( * ) Notice: Subject to any disclaimer, the term of this patent is extended or adjusted under 35 U.S.C. 154(b) by 0 days.

(21) Appl. No.: 19/270,631

(22) Filed: Jul. 16, 2025

(51) Int. Cl.
*E21B 43/12* (2006.01)

(52) U.S. Cl.
CPC ..... *E21B 43/123* (2013.01)

(58) Field of Classification Search
CPC ..... E21B 43/122; E21B 43/123
See application file for complete search history.

(56) References Cited

U.S. PATENT DOCUMENTS 7,500,523 B2 * 3/2009 Coon ..... E21B 34/063 166/321
10,883,349 B2 * 1/2021 Campbell ..... E21B 43/129
2006/0225893 A1 * 10/2006 Coon ..... E21B 34/063 166/105
2011/0284242 A1 * 11/2011 Frazier ..... E21B 34/063 166/376
2019/0093461 A1 * 3/2019 Campbell ..... E21B 43/129
2020/0270975 A1 * 8/2020 Whiteman ..... E21B 43/122

* cited by examiner

*Primary Examiner* — Shane Bomar
(74) *Attorney, Agent, or Firm* — Orin Del Vecchio

(57) ABSTRACT

A gas lift mandrel having a valve assembly that is installed and operably coupled to a well tube wherein the mandrel is installed in alternate quantities in a vertical arrangement on the well tube. The mandrel includes a body having a wall member and an interior volume. Disposed within the interior volume is a valve assembly having a sleeve member wherein the valve assembly is movable between a first position and a second position. A gas capillary tube member is operably installed wherein a second end is sealably secured to a burst disc member and a first end is operably coupled to a hydraulic pump located on the surface. In its first position the valve assembly allows gas to enter a gas aperture and exit through a passage formed in the body. In its second position the valve assembly moves to inhibit fluid flow through the gas aperture and passage.

5 Claims, 4 Drawing Sheets

GAS LIFT MANDREL

FIELD OF THE INVENTION

The present invention relates generally to gas lift mandrels, more specifically but not by way of limitation, a gas lift mandrel equipped with a custom hydraulic cylinder, burst disc holder and custom sleeve that is operably coupled with a capillary line to a surface located hydraulic pump wherein the sleeve can be moved to dummy off the valves to improve gas lift and efficiency.

BACKGROUND

Gas lift is a widely used artificial lift method in oil and gas wells, particularly effective for enhancing production in mature or low-pressure reservoirs. Central to this system are gas lift mandrels, which serve as the primary housing for gas lift valves. These mandrels allow controlled injection of high-pressure gas into the production tubing to lighten the hydrostatic column and facilitate fluid flow to the surface. Among the different types of mandrels, side pocket mandrels are prevalent for their specialized design and functionality. Gas lift mandrels are tubular devices installed in the production tubing string. Their primary function is to house and support gas lift valves, which regulate the entry of lift gas into the wellbore. Gas lift operations involve injecting compressed gas from the surface through the casing annulus into the tubing via the gas lift valves. This process reduces the density of the produced fluid, thereby decreasing bottom-hole pressure and enhancing the well's production rate. Mandrels come in two primary configurations, conventional (tubing-retrievable) mandrels and side pocket mandrels. While conventional mandrels have valves permanently attached and retrieved with the tubing, side pocket mandrels allow wireline-retrievable valves, offering flexibility for valve replacement or adjustment without pulling the entire tubing string.

Side pocket mandrels offer several advantages. Side pocket mandrels are designed with an offset side pocket where the gas lift valve is installed. This allows for wireline intervention to retrieve or replace the valve without requiring a tubing pull, significantly reducing operational downtime and costs. Side pocket mandrels also provide multiple injection points. Side pocket mandrels facilitate installation of multiple valves at different depths, allowing staged gas injection for optimal reservoir management. Another advantage of side pocket mandrels are their efficiency and added safety benefits. Wireline-serviced side pocket mandrels enhance safety by minimizing heavy rig operations and enabling quick valve replacement, often achievable with minimal disruption to production. Side pocket mandrels are widely used and supported by industry-standard wireline tools, ensuring compatibility and availability of service equipment globally. There are intrinsic disadvantages to side pocket mandrels. Despite their flexibility in valve retrieval, side pocket mandrels themselves are fixed components of the tubing string. If the mandrel becomes damaged, corroded, or blocked, it requires a full tubing pull for replacement, which is both time-consuming and costly. Traditional side pocket mandrels rely on pressure-actuated valves, lacking dynamic controllability from the surface. Adjustments to injection rates or shut-in operations require physical intervention. The design of side pocket mandrels introduces additional mechanical components and potential leak paths, requiring careful installation and maintenance practices.

A significant technological advancement would be the development of gas lift mandrels capable of surface-controlled operation, where the gas lift valve could be remotely actuated to on and off positions without physical intervention downhole. Such innovation would offer several benefits: Surface-controlled mandrels would allow operators to adjust gas injection rates in real-time based on changing well conditions, enhancing production efficiency. By eliminating the need for wireline interventions for valve cycling, operators could minimize downtime and achieve considerable cost savings over the well's life. Remote controllability would support intelligent well systems, facilitating automated production optimization, reservoir management, and integration with digital oilfield technologies. Surface-controlled systems could help avoid unnecessary wear on mandrels and valves by providing precise control, reducing the frequency of intrusive interventions.

Gas lift mandrels are indispensable components in artificial lift systems, enabling efficient hydrocarbon production through controlled gas injection. Side pocket mandrels, in particular, offer operational advantages by facilitating wireline-retrievable valve operations. However, they still present challenges, notably the need for tubing pulls when the mandrel itself requires servicing and the lack of dynamic surface control. The development of gas lift mandrels with surface-controlled valves represents a transformative opportunity for the industry, promising enhanced flexibility, reduced intervention costs, and improved production optimization. As technological innovations progress, such advancements will likely redefine gas lift operations in the years to come.

Accordingly, there is a need for a gas lift mandrel equipped with a custom hydraulic cylinder, burst disc holder and custom sleeve that is operably coupled with a capillary line to a surface located hydraulic pump wherein the sleeve can be moved to dummy off the valves to improve gas lift and efficiency.

SUMMARY OF THE INVENTION

It is the object of the present invention to provide a gas lift mandrel valve having an elongated body operably coupled to well tubing.

Another object of the present invention is to provide a gas lift mandrel valve that is fluidly controlled from a surface location wherein the present invention includes a hydraulic cylinder mounted within the interior volume of the body.

A further object of the present invention is to provide a gas lift mandrel valve wherein the present invention further includes a burst disc holder disposed within the interior volume of the body.

Yet a further object of the present invention is to provide a gas lift mandrel valve further includes a slidable sleeve member movable between a first position and a second position.

Still another object of the present invention is to provide a gas lift mandrel valve wherein the present invention includes a capillary tube member that is operably coupled to the valve assembly of the present invention and a pump source located on the surface.

An additional object of the present invention is to provide a gas lift mandrel valve further that includes a port configured to fluidly coupled the valve assembly with the interior volume of the well tubing.

Yet a further object of the present invention is to provide a gas lift mandrel valve wherein the present invention wherein the body includes a gas entry aperture.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
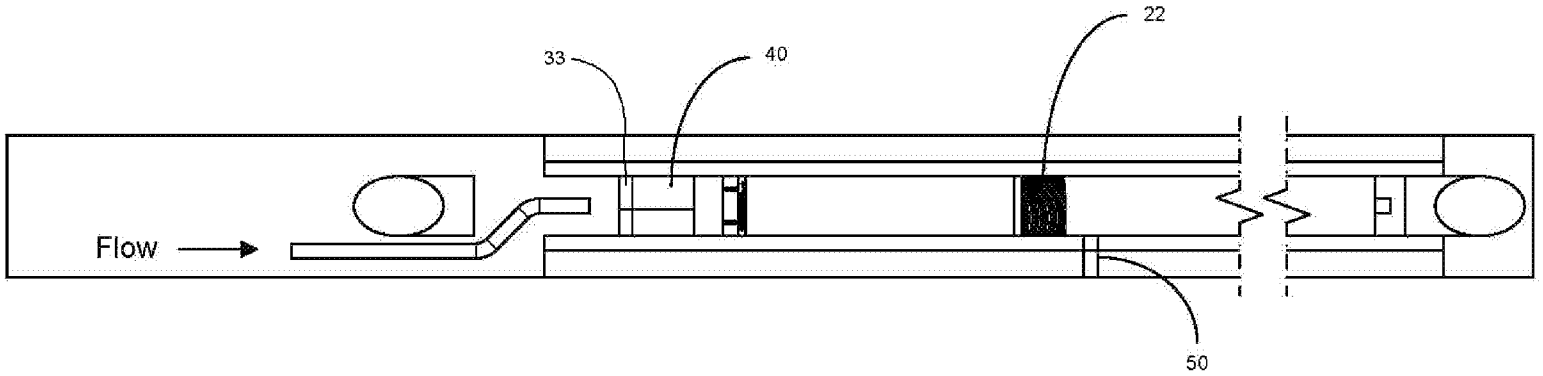
FIG. 1 is cross-sectional diagrammatic view of an embodiment of the present invention.
Figure 2:
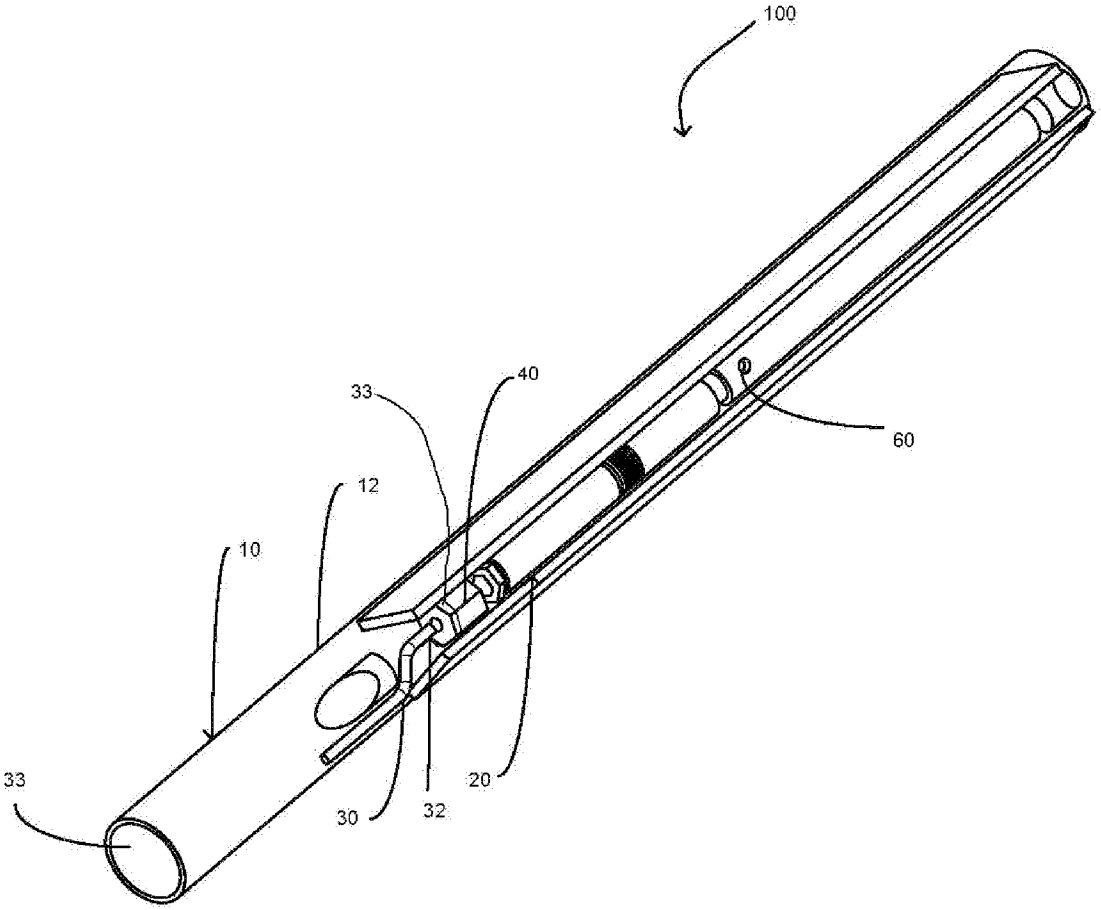
FIG. 2 is a perspective diagrammatic view.
Figure 3:
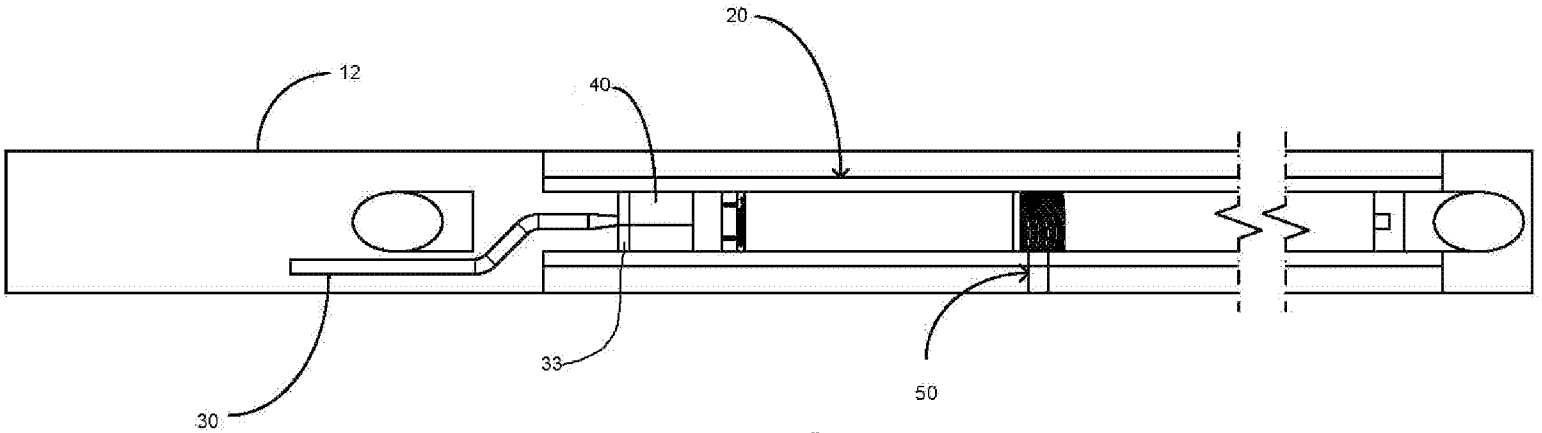
FIG. 3 is a side diagrammatic view.
Figure 4:
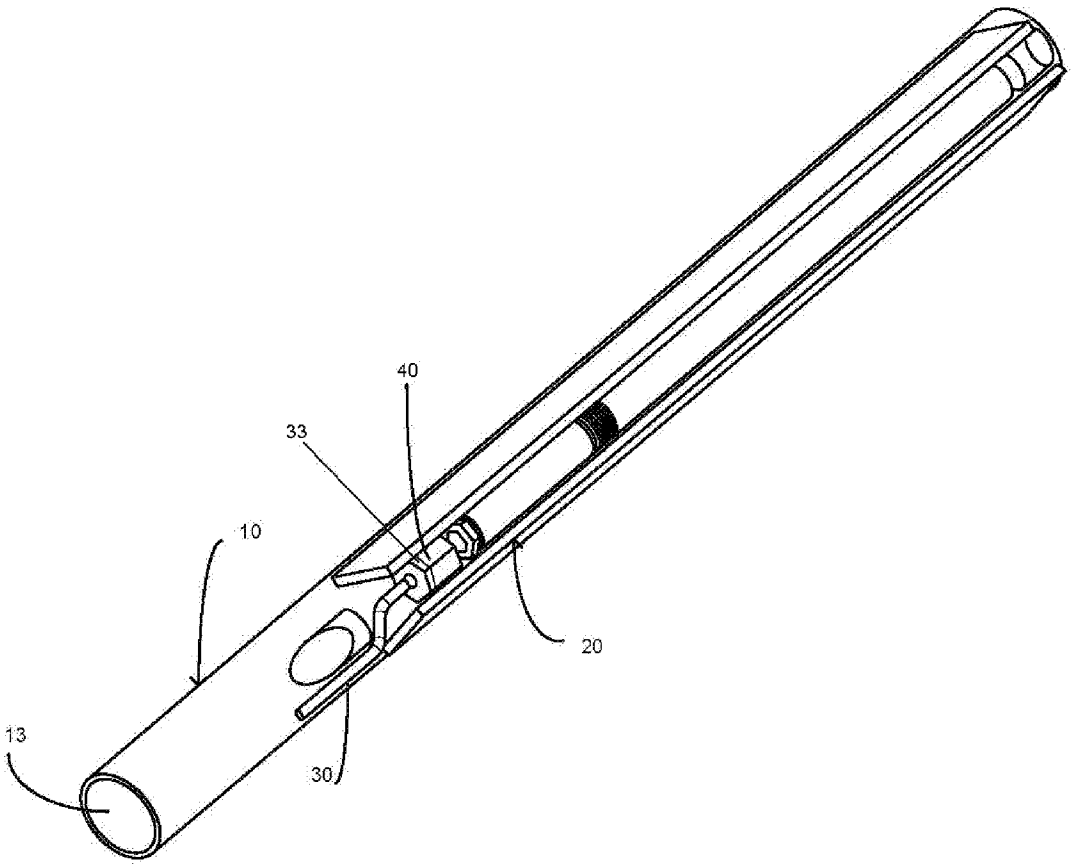
FIG. 4 is a perspective diagrammatic view.

Referring now to the drawings submitted herewith, wherein various elements depicted therein are not necessarily drawn to scale and wherein through the views and figures like elements are referenced with identical reference numerals, there is illustrated a gas lift mandrel valve assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the gas lift mandrel valve assembly 100 is operably coupled to a well tubing and is configured to have a sleeve member movable between a first position and a second position so as to dummy off the gas lift in a top down sequence in a well installation. Additionally, the present invention design allows a well operator to avoid having to pull tubing when a valve is washed above fluid level. Furthermore, the design of the present invention facilitates movement of a valve to an off position from the surface as the well's fluid level depletes in order to improve gas lift delivery and efficiency.

The gas lift mandrel valve assembly 100 includes a body 10 having a wall member 12 wherein the body 10 includes an interior volume 13. The body 10 is elongated and cylindrical in shape being manufactured from a durable rigid material such as but not limited to metal. It should be understood within the scope of the present invention that the body 10 could be manufactured in alternate diameters and lengths. The interior volume 13 has operably disposed therein a gas capillary tube member 30. The gas capillary tube member 30 is manufactured from metal tubing or similar suitable material. The gas capillary tube member 30 includes a second end 32 that is operably coupled proximate the valve assembly 20. The second end 32 is sealably secured utilizing fastener 33. The first end of the gas capillary tube member 30 is operably coupled to a hydraulic pump (not particularly illustrated herein) located on the surface proximate the head of the well on which the gas lift mandrel valve assembly 100 is installed. It should be understood within the scope of the present invention that a plurality of the gas lift mandrel valve assembly 100 are installed vertically along a well tube so as to facilitate the operation thereof. The hydraulic pump is utilized to introduce a fluid into the gas capillary tube member 30 providing pressurization thereof.

Proximate the second end 32 of the gas capillary tube member 30 is a burst disc member 40. The burst disc member 40 of the present invention is a conventional burst disc assembly that utilizes a metallic foil or graphite membrane located inside the burst disc member 40 that will rupture whenever the pressure applied thereto exceeds the bursting pressure of the disc. As soon as the rupture disc of the burst disc member 40 bursts, the pressure will facilitate the movement of the valve assembly 20 from a first position to a second position closing passage 50.

The valve assembly 20 includes sleeve member 22 that is movable between a first position and a second position. In its first position, the sleeve member 22 places the valve assembly in an open position. In an open position fluid can flow through passage 50 and aperture 60. Gas in the adjacent well tube enters aperture 60 and exits passage 50 and opening thereof. Subsequent the fluid pressure in the gas capillary tube member 30 being increased to exceed the pressure threshold of the burst disc member 40 the valve assembly 20 is moved to its closed position wherein sleeve member 22 is slidably moved so as to cover the passage 50 inhibiting flow of gas through aperture 60. As a plurality of the present invention are installed on a well tube, the gas lift mandrel valve assemblies 100 are configured wherein the pressure rating for the burst disc member 40 is incrementally higher starting from the surface. This facilitates the ability for each valve to be moved to a closed position in a sequence allowing an operator to stop at a desired location along the well tube. It is further contemplated within the scope of the present invention that a spring could be placed adjacent the sleeve member 22 wherein the spring would be operable to return the sleeve member 22 to its first position so as to permit flow of fluid through passage 50.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A gas lift mandrel configured to be operably coupled to a well tubing wherein the gas lift mandrel comprises:

a body, said body having a wall member, said wall member defining an interior volume, said body having a first end and a second end;

a gas capillary tube member, said gas capillary tube member having a first end and a second end, said gas capillary tube member being hollow, said gas capillary tube member being operably coupled to a pump proximate said first end of said gas capillary tube member wherein the pump is located on a surface proximate a well, said second end of said capillary tube member terminating within the interior volume of said body;

a burst disc member, said burst disc member being disposed within said interior volume of said body, said burst disc member being sealably coupled to said second end of said gas capillary tube member, said burst disc member having a membrane operable to rupture ensuing exposure to a determined pressure;

a valve assembly, said valve assembly further including a sleeve member, said sleeve member configured to be movable between a first position and a second position; and wherein said sleeve member of said valve assembly is moved to said second position ensuing rupture of said burst disc member resulting in exposure of said valve assembly to pressure from a fluid disposed in said gas capillary tube member.

2. The gas lift mandrel as recited in claim 1, wherein said wall member of said body further includes a passage bored therethrough, said passage being proximate said valve assembly.

3. The gas lift mandrel as recited in claim 2, wherein said passage includes a gas aperture, wherein said gas aperture is exposed to an interior volume of a well tubing, said gas aperture configured to permit gas to flow into said passage when said valve assembly is in said first position.

4. The gas lift mandrel as recited in claim 3, wherein in said second position said sleeve member of said valve assembly is superposed said passage so as to inhibit flow of gas into said interior volume of said body.

5. The gas lift mandrel as recited in claim 4, wherein said body is elongated and cylindrical in shape.

* * * * *